US005180877A

United States Patent [19]

Kunimoto

[11] Patent Number: 5,180,877

[45] Date of Patent: Jan. 19, 1993

[54] MUSICAL TONE SYNTHESIZING APPARATUS USING WAVE GUIDE SYNTHESIS

[75] Inventor: Toshifumi Kunimoto, Hamamatsu, Japan

[73] Assignee: Yamaha Corporation, Hamamatsu, Japan

[21] Appl. No.: 558,059

[22] Filed: Jul. 26, 1990

[30] Foreign Application Priority Data

Jul. 27, 1989 [JP] Japan ..... 1-194580

[51] Int. Cl.[5] ..... G10H 1/14; G10H 5/00

[52] U.S. Cl. ..... 84/624; 84/625; 84/660; 84/DIG. 10; 84/DIG. 26

[58] Field of Search ..... 84/622, 624, 625, 630, 84/659, 660, 661, DIG. 26, DIG. 9, DIG. 10

[56] References Cited

U.S. PATENT DOCUMENTS

| | | | |
|---|---|---|---|
| 4,130,043 | 12/1978 | Niimi | 84/622 X |
| 4,265,158 | 5/1981 | Takahashi et al. | 84/622 X |
| 4,641,564 | 2/1987 | Okamoto | 84/DIG. 9 |
| 4,736,663 | 4/1988 | Wawrzynek | 84/627 |
| 4,815,354 | 3/1989 | Kunimoto | 84/DIG. 9 |
| 4,984,276 | 1/1991 | Smith | 84/630 |

FOREIGN PATENT DOCUMENTS

| | | |
|---|---|---|
| 0235538 | 10/1990 | European Pat. Off. . |
| 63-40199 | 2/1988 | Japan . |

*Primary Examiner*—William M. Shoop, Jr.
*Assistant Examiner*—Brian Sircus
*Attorney, Agent, or Firm*—Graham & James

[57] ABSTRACT

A musical tone synthesizing apparatus synthesizes musical tones by simulating the tone generation construction of a plucked-string or struck-string instrument. The apparatus has a loop circuit which simulates a vibrating element of the instrument, an excitation circuit creates an excitation signal corresponding to the excitation given to the vibrating element in response to the operation of operators such as a pick or a hammer or the state of the generation body and a memory which stores a non-linear relation between the operator and the vibration element. The excitation signal circulates around the loop circuit and is delayed by means of a delay circuit with a previously determined delay interval, and is fed back into the excitation circuit as the state of the vibrating element. To realize a variety of sounds depending upon characteristics of the operator, such as the shape and hardness of the pick or the hardness of the hammer, a readout value of the memory, which is read out according to such characteristics, is supplied to the loop circuit.

16 Claims, 3 Drawing Sheets

MUSICAL TONE SYNTHESIZING APPARATUS USING WAVE GUIDE SYNTHESIS

BACKGROUND OF THE INVENTION

1. Field of the Invention

This invention relates to a musical tone synthesizing apparatus which is used in the synthesis of the musical tones of plucked-string or struck-string instruments.

2. Prior Art

Devices which put into operation a model obtained by simulating the tone production mechanism of an acoustic musical instrument and thus synthesize the tones of the acoustic musical instrument are commonly known. Conventionally, devices which synthesize the tones of stringed musical instruments are known which have a construction in which a non-linear amplifying component which simulates the elastic characteristics of the strings is combined in a closed loop with a delaying circuit which has a delay interval corresponding to the harmonic cycle of the strings. In this type of musical tone synthesizing apparatus, this loop circuit is brought to a resonant state and a fixed signal is circulated in the loop circuit. Furthermore, the signal circulating in the loop is taken for use as the musical tone signal. This type of technology was disclosed in Japanese Patent Application, Laid-open publication no. Sho 63-40199, and U.S. Pat. No. 4,130,043.

In the conventional musical tone synthesizing apparatuses described above, in the case of a plucked-string instrument such as a guitar, for example, as the stiffness or shape of the pick change, the behavior of the string when plucked changes, so that differing tones are generated. Furthermore, in struck-string instruments such as pianos, as the hardness, etc., of the hammers change, differing musical tones are generated. However, in conventional musical tone synthesizing apparatuses, the state and action of the physical system in which the strings are excited, such as the stiffness and shape of the pick, the hardness of the hammers, etc., were not simulated, so that the musical tones could not be synthesized with fidelity.

SUMMARY OF THE INVENTION

Accordingly, it is a purpose of this invention, in view of the circumstances described above, to provide a musical tone synthesizing apparatus which can carry out the synthesis of musical tones of stringed instruments with fidelity, taking into account the action of the physical system of hammers, picks, and the like which excites the strings.

Therefore, this invention provides a musical tone synthesizing apparatus for simulating tones of a conventional musical instrument, where the conventional musical instrument is such that it comprises a vibrating element having predetermined resonance characteristics, and an operator for imparting mechanical energy to the vibrating element so that the vibrating element vibrates, thereby generating a musical tone. The musical tone synthesizing apparatus comprises (a) closed-loop means functioning as a closed loop circuit and including delay means having a delay interval corresponding to a reciprocation period of the reciprocal propagation of vibrations generated by the vibrating element, and (b) excitation means for creating an excitation signal corresponding to the excitation imposed upon the vibrating element by the operator of the conventional musical instrument according to the state of the vibrating element and operation of the operator, the excitation means supplying the created excitation signal into the closed-loop means.

In other words, an excitation signal is generated by the excitation means in response to the operation of the operator, according to said excitation signal the loop circuit is excited and brought to a resonant state, and said excitation signal is taken for use as the musical tone signal.

By means of this, it is possible to carry out the synthesis of the musical tones of stringed instruments with fidelity, taking into account the action of the physical system of hammers, picks, and the like which excites the strings.

BRIEF DESCRIPTION OF THE DIAGRAMS

Figure 4:
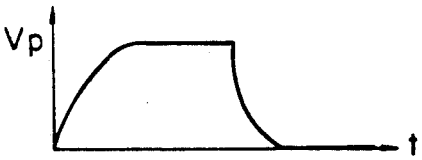
Figure 4:
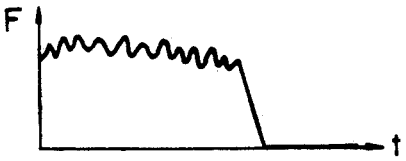

FIGS. 4 (*a*) and (*b*) are waveform diagrams showing examples of the output signal of excitation signal generating circuit 15 in the same preferred embodiment.

Figure 5:
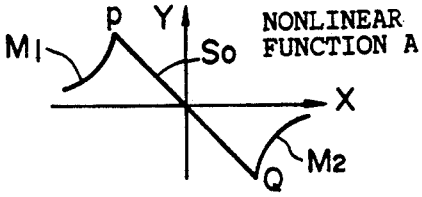

FIG. 5 is a waveform diagram showing an example of a nonlinear function A in the same preferred embodiment.

Figure 6:
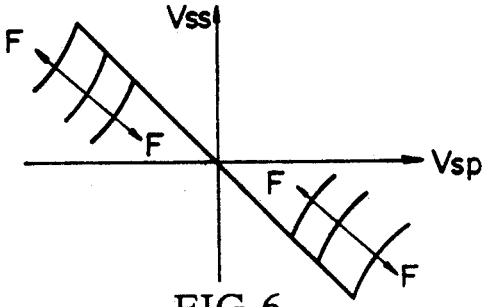

FIG. 6 is a waveform diagram showing the signal Vsp and signal Vss functions in the same preferred embodiment.

Figure 7:
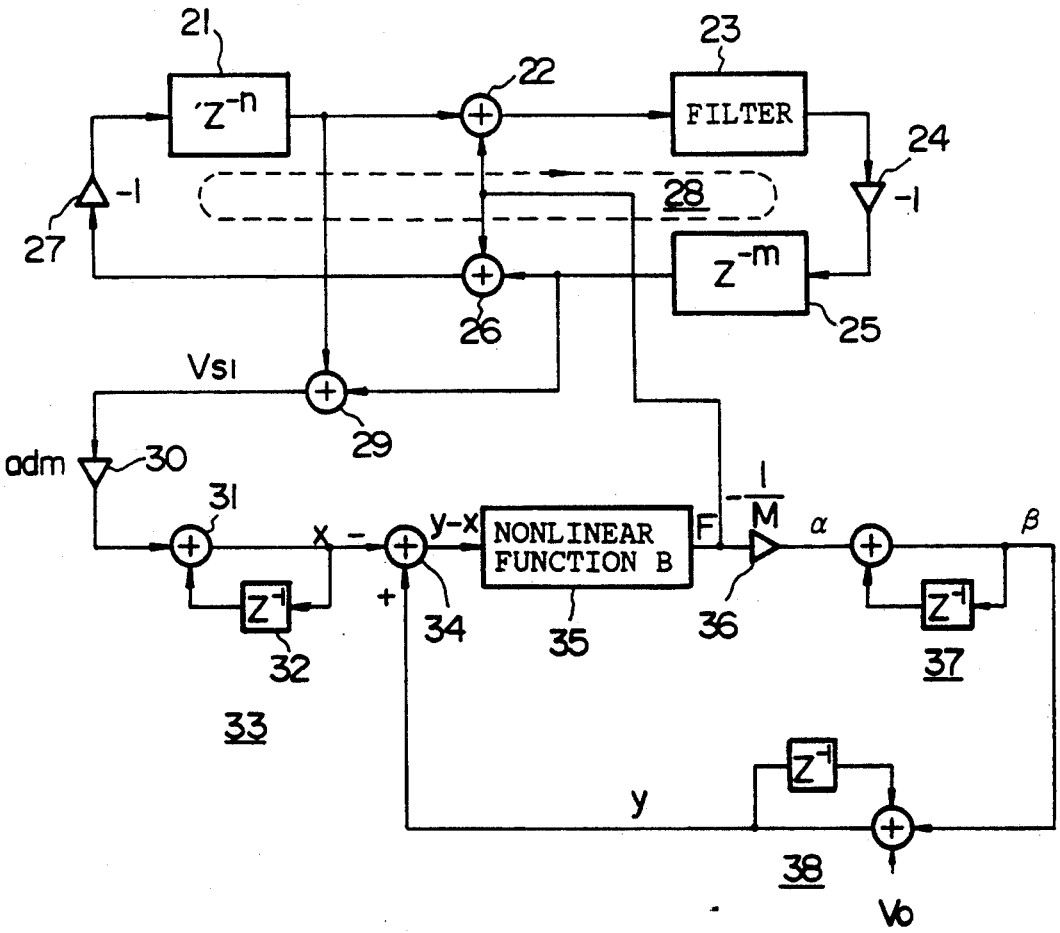

FIG. 7 is a block diagram showing the construction of a musical tone synthesizing apparatus according to the second preferred embodiment of the invention.

Figure 8:
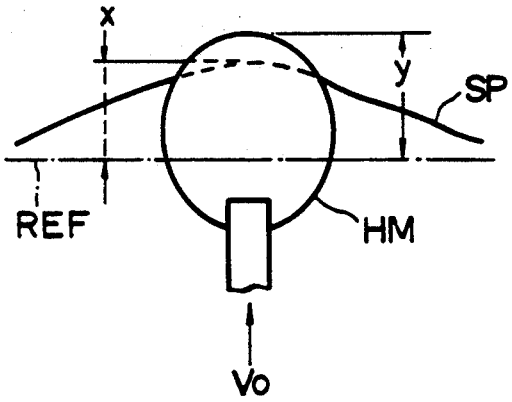

FIG. 8 is a simulation model for the purpose of explaining the point at which hammer HM strikes piano string SP.

Figure 9:
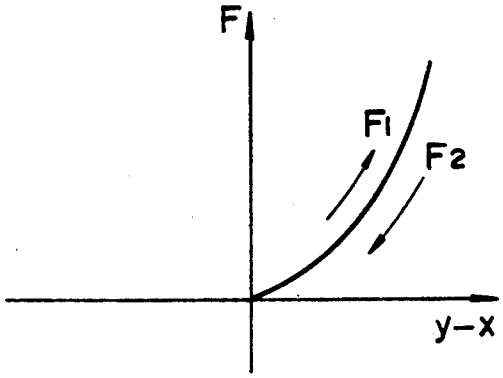

FIG. 9 is a waveform diagram showing an example of a nonlinear function B in the same preferred embodiment.

Figure 10:
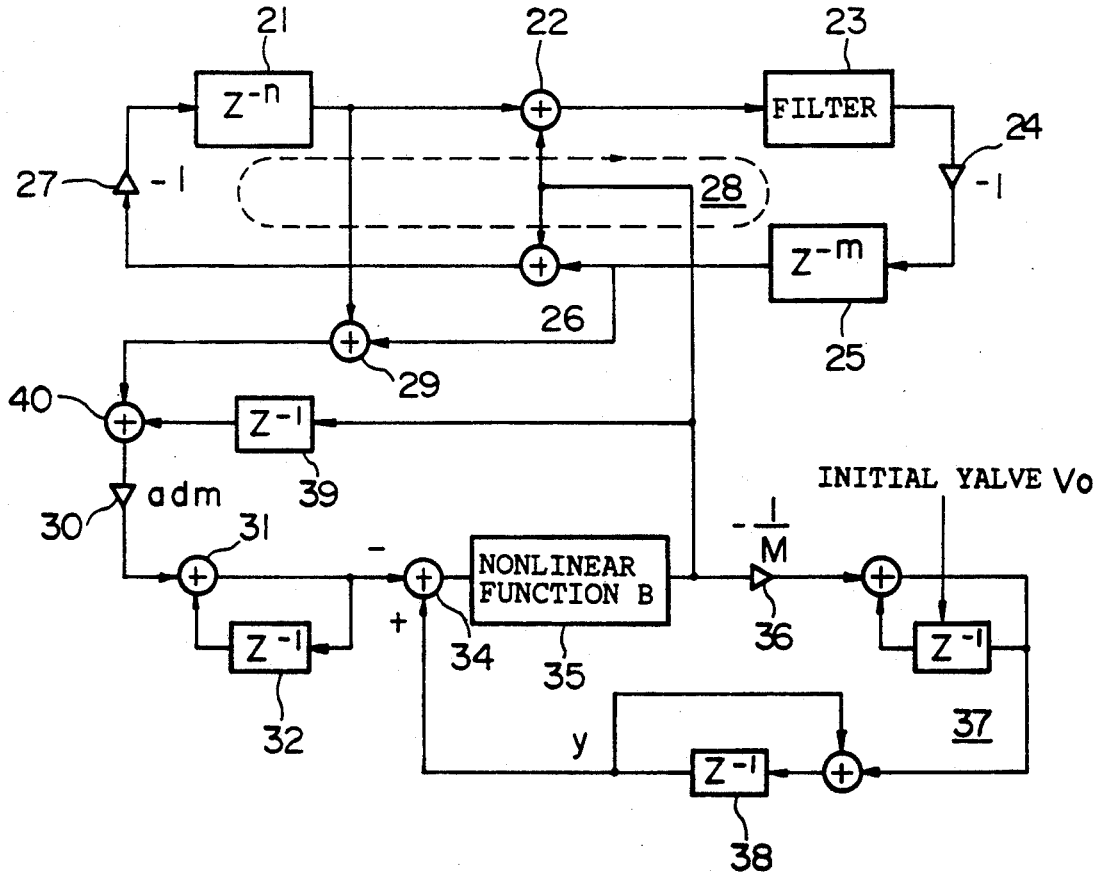

FIG. 10 is a block diagram showing the construction of a modified example of the same preferred embodiment.

DETAILED DESCRIPTION OF THE PREFERRED EMBODIMENTS

First Preferred Embodiment

Figure 1:
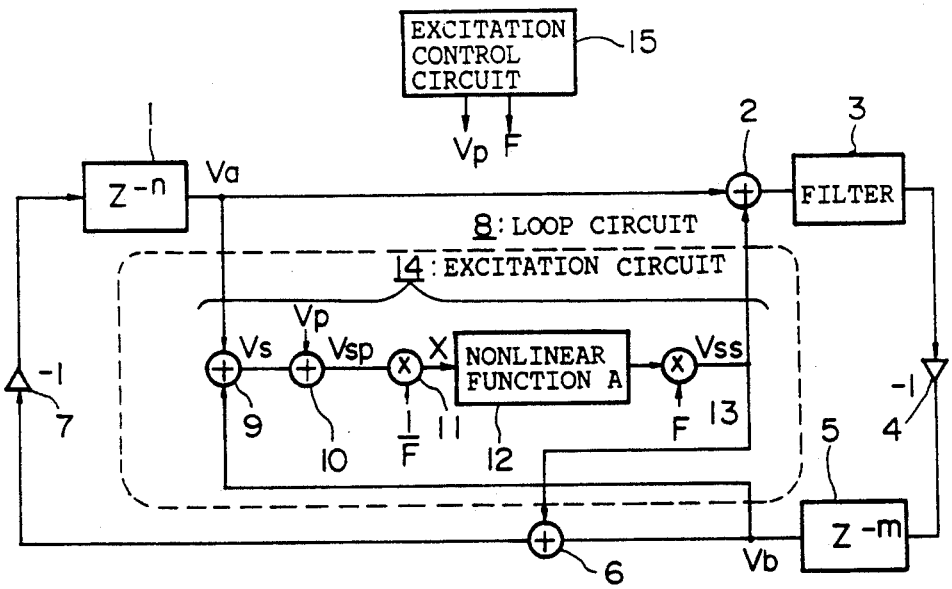
FIG. 1 is a block diagram showing the construction of a musical tone synthesizing apparatus according to the first preferred embodiment of the invention.

FIG. 1 shows the construction of a musical tone synthesizing apparatus according to the first preferred embodiment of the invention. In FIG. 1, an example of the construction in the case in which the musical tone synthesizing apparatus is realized by using digital circuitry is shown. Delay circuits 1 and 5 are constructed by shift registers; each of these shift registers comprises flip-flops corresponding to the number of bits in the transmitted digital signals. In addition, sample clocks are supplied at fixed intervals in each flip-flop. The letters n and m attached to delay circuits 1 and 5 show the number of registers. The other essential elements of the construction are realized by digital circuitry in the same way as delay circuits 1 and 5. In this musical tone synthesizing apparatus the tones of a plucked-string musical instrument such as a guitar, etc., are synthesized. Loop circuit 8 in FIG. 1 comprises delay circuit 1, adder 2, filter 3, phase inverting circuit 4, delay circuit 5, adder 6, and phase inverting circuit 7; it simulates the vibration of the strings of a guitar and the like.

At this point, the vibration of the strings of a guitar or the like will be explained with reference to FIG. 2. When the central part of a string S of a guitar is plucked by a pick or fingernail, a vibration wave Wa moving in the direction from fixed end $T_2$ toward $T_1$ and a vibration wave Wb moving in the direction from fixed end $T_1$ toward $T_2$ are generated in string S. Here, the fixed ends $T_1$ and $T_2$ correspond to the bridge and frets of a guitar. In this case, the vibration wave Wa is phase-inverted at fixed end $T_1$, becomes a new wave, and is propagated toward fixed end $T_2$, while vibration wave Wb is phase-inverted at fixed end $T_2$, becomes a new wave, and is propagated toward fixed end $T_1$. String S vibrates according to the waveform resulting from the addition of vibration waves Wa and Wb, and eventually vibrates according to a standing wave Ws which has its widest area in the vicinity of the center of the string.

Figure 2:
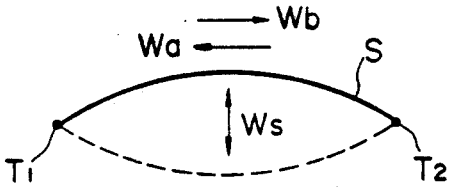
FIG. 2 is a simulation model of a plucked-string instrument.

Delay circuits 1 and 5 in FIG. 1 both correspond to string S in FIG. 2; the delay intervals are set to the amount of time necessary for the propagation of vibration wave Wa to fixed end $T_1$ and the propagation of vibration wave Wb to fixed end $T_2$. Furthermore, inverting circuits 4 and 7 correspond to the fixed ends $T_1$ and $T_2$ in FIG. 2; by them the phenomenon of the phase inversion of vibration waves Wa and Wb at each fixed end is simulated. By means of this, the time which it takes the signal to travel once around loop circuit 8 becomes equal to the vibrational cycle of standing wave Ws. Accordingly, by the use of the signal transmitted around loop circuit 8, a musical tone signal with a pitch which corresponds to the length of string S can be obtained. In addition, filter 3 simulates the frequency characteristics of the decrease in vibration in string S.

Excitation circuit 9, comprising adders 9 and 10, multiplier 11, ROM 12, and multiplier 13, simulates the action of the pick or the fingernail on the string when it is plucked.

Output signal Va of delay circuit 1 and output signal Vb of delay circuit 5 are added by adder 9. Here, signals Va and Vb correspond to vibration waves Wa and Wb in the central part of string S in FIG. 2; by adding them together, a signal Vs which corresponds to the velocity in the central area of string S is obtained. Then, signal Vp, which corresponds to the velocity of pick PK, is added to signal Vs by adder 10, and a signal Vsp corresponding to the relative velocity of pick PK and string S is outputted. Here, signal Vp is outputted from excitation control circuit 15 at the time of the generation of the musical tones. FIG. 4(*a*) shows an example of the signal waveform of the signal Vp. In this musical tone synthesizing apparatus, the positive direction of movement of pick PK and the positive direction of movement of string S are defined as opposite directions. In other words, in the case where, for example, at the time when the pick PK is moving downward, its movement velocity is positive, the upward velocity in string S is defined to be positive movement velocity.

Figure 3:
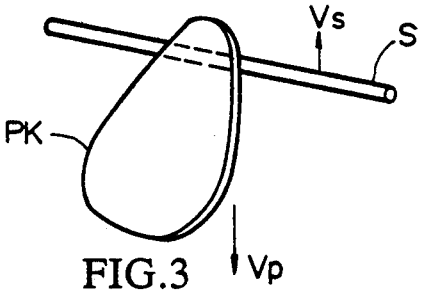
FIG. 3 is an angled view showing the plucking of the string S of FIG. 2 by means of pick PK.

As FIG. 3 shows, in the case in which string S is plucked by pick PK, at the initial time of plucking, starting friction is in operation between pick PK and string S, and string S follows the action of pick PK and is displaced; however, once plucking is under way, string S is displaced with some slippage with respect to pick PK. A table of the nonlinear function A, which models this sort of response of string S to pick PK, is stored in ROM 12. FIG. 5 shows an example of this nonlinear function A. The vertical line $S_0$ in this same diagram corresponds to the area by which string S is displaced in following pick PK when starting friction is in operation between string S and pick PK. Curves $M_1$ and $M_2$ correspond to the area by which string S is displaced with some slippage with respect to pick PK when dynamic friction is in operation between string S and pick PK.

The greater the force of pick PK, the more string S follows pick PK in its displacement. In order to reproduce this action with fidelity, it is necessary to enlarge the range of area $S_0$ (the range from point P to point Q) in correspondence with the force of pick PK. In the present preferred embodiment, when a musical tone signal is generated, a signal F corresponding to the force of pick PK is outputted from excitation signal generating circuit 15, the input signal is multiplied by 1/F by multiplier 11 and inputted into ROM 12; in addition, the output of ROM 12 is multiplied F times by multiplier 13. An example of signal F is shown in FIG. 4 (*b*). Therefore, the nonlinear function A describing the transmission characteristics between input signal Vsp of multiplier 11 and output signal Vss of multiplier 13 is enlarged F times in the directions of the X-axis and the Y-axis in FIG. 2. Accordingly, in this preferred embodiment, it is possible to change the range in which signal Vss follows signal Vsp in correspondence with the force of pick PK. In addition, the output signal Vss of multiplier 13 is made an excitation signal and inputted into loop circuit 8 through the medium of adders 2 and 6.

In this preferred embodiment, the pick PK plucks at the middle of string S, so that in order to model the plucking mechanism of an actual guitar with fidelity, delaying circuits 1 and 5 were divided in two corresponding to the plucking position on string S, and in between these points of division excitation circuit 14 is inserted; it is preferable to conduct the detection of the velocity of the string (Va and Vb) and the output of excitation signal Vss by means of this. However, even if this is done, the time it takes for the excitation signal Vss which is inputted at a point of division to go halfway around the loop circuit 8 and reach a different point of division is equal to the delay interval of delay circuits 1 and 5; this equal-value circuit is exactly the same as that in FIG. 1.

Here, the operation of the musical tone synthesizing apparatus will be explained. When a musical tone is generated, signals Vp and F shown in FIG. 4 (*a*) and (*b*) are outputted by the excitation signal generating circuit 15 and supplied to excitation circuit 14. Then, signal Vp corresponding to the velocity of the pick PK is added to signal Vs corresponding to the velocity of string S by adder 10, and signal Vsp corresponding to the relative velocity of pick PK and string S is outputted. At this time, in the case in which a signal corresponding to the excess vibration from previous plucking is circulating around loop circuit 8, a signal Vs corresponding to the strength of this excess vibration is outputted by adder 9, and the signal Vs is added to signal Vp to obtain the signal Vsp.

On the other hand, in the case in which the circulating signal in loop circuit 8 has been extinguished, as the time lapse since the previous plucking was long, signal Vs becomes 0. Accordingly, signal Vp is outputted as signal Vsp.

In addition, in the case in which signal Vsp is within the straight-line area in FIG. 6, a signal Vss according to the equation Vss TM -Vsp is outputted from multiplier 13 and inputted as an excitation signal into loop circuit 8 through the medium of adders 2 and 6. In this way, in the case in which starting friction is in operation between string S and pick PK, a signal Vss which indicates the velocity of string S following the movement velocity of pick PK is inputted into loop circuit 8.

On the other hand, if signal Vsp becomes large, or if the force of pick PK becomes small, and signal Vsp is outside the straight-line area in FIG. 6, a signal Vss which is determined by means of the transmission characteristics of the curved line areas is inputted into loop circuit 8 as an excitation signal. In this way, in the case in which string S slips with respect to pick PK, a signal Vss which indicates the velocity of string S is generated and inputted into loop circuit 8.

In loop circuit 8, the excitation signal Vss which is inputted by adder 2 progresses through filter 3→inverting circuit 4→delay circuit 5, and is reinputted by adder 9 of excitation circuit 14. Furthermore, the excitation signal Vss which is inputted by adder 6 progresses through inverting circuit 7→delay circuit 1, and is reinputted into excitation circuit 14. This operation is in response to the phenomenon in which pick PK causes string S to vibrate as shown in FIG. 3, this vibration propagates to the left and right from the plucking position, is reflected at the fixed ends, and returns again to the plucking position. Then, in excitation circuit 14, a signal Vs corresponding to the velocity of string S at the plucking position is obtained by adder 9. Next, in excitation circuit 14, based on this signal Vs, signal Vp from excitation control circuit 15, and F, a new excitation signal Vss is put into operation by the operation described above, and is inputted into loop circuit 8.

The same operation is carried out for the period in which signal F is being outputted, in other words, for the period in which pick PK is in contact with string S. When pick PK is separated from string S and F becomes 0, the output Vss of multiplier 13 is set to 0, and excitation circuit 14 is detached from loop circuit 8. After this, the excitation signal which was inputted into loop circuit 8 in this way circulates around loop circuit 8, is gradually diminished by filter 3 and eventually extinguished. The signal circulating around loop circuit 8 is fetched as a musical tone signal, and a musical tone is generated. The position at which this musical tone signal is fetched can be any position on loop circuit 8. According to this musical tone synthesizing apparatus, the waveform of the excitation signal can be controlled with respect to loop circuit 8 by means of the adjustment of signal Vp, which is generated by excitation control circuit 15, and signal F, and it is thus possible to adjust the tone color of the tones to match that of an actual musical instrument.

Second Preferred Embodiment

FIG. 7 is a block diagram showing the construction of a musical tone synthesizing apparatus according to a second preferred embodiment of the present invention. In this musical tone synthesizing apparatus, tones of struck-string musical instruments such as pianos and the like are created. Loop circuit 28, which comprises delay circuit 21, adder 22, filter 23, phase-inverting circuit 24, delay circuit 25, adder 26, and phase-inverting circuit 27, simulates the vibration of the strings of a piano in the same way as the aforesaid first preferred embodiment.

The output signals of delay circuits 21 and 22 are added by adder 29 and outputted as signal $Vs_1$, which corresponds to the velocity of the string. This signal $Vs_1$ is multiplied by a coefficient adm by multiplier 30. This coefficient adm will be discussed later.

The output signal of multiplier 30 is integrated by integrating circuit 33, which comprises adder 31 and one-sample period delay circuit 32. As a result, integrating circuit 33 outputs a signal x which corresponds to the displacement of the piano string SP from a basic line REF shown in FIG. 8, and the signal x is inputted into subtracter 34. Signal y (see FIG. 8), which corresponds to the displacement of hammer HM and which is outputted by integrator 38, discussed later, is inputted into the other input end of subtracter 34. Then subtracter 34 outputs a signal $y-x$, which indicates the difference between signal y and signal x, in other words, a signal which corresponds to the relative displacement of hammer HM and string SP. Here, in the case in which hammer HM strikes string SP, $y-x$ is positive, and a reverse force corresponding to the amount of the strike operates between string SP and hammer HM. On the other hand, in the case in which hammer HM only lightly touches string SP or in which hammer HM is separated from string SP, $y-x$ is either 0 or negative, and the reverse force becomes 0. A table of the nonlinear function B which indicates the relationship between the relative displacement $y-x$ of string SP and hammer HM and the reverse force F which operates between string SP and hammer HM is stored in ROM 35. FIG. 9 shows an example of this nonlinear function B in the case in which hammer HM is constructed of soft materials such as felt. As this diagram shows, in the case in which $y-x$ is 0 or negative, in other words, in the case in which hammer HM does not strike string SP, the reverse force is 0, and in the case in which hammer HM strikes string SP, reverse force F rises slowly in response to the increase in the relative displacement $y-x$. In the case in which hammer HM is made of hard materials, nonlinear function B is set so that F rises rapidly with respect to $y-x$.

In this way, a signal F corresponding to the reverse force in response to the relative displacement $y-x$ of hammer HM and string SP with a time lapse is obtained from ROM 35, and this signal F is multiplied by a multiplying coefficient of $-1/M$ by multiplier 36. Here, M designates a coefficient corresponding to the inertial mass of hammer HM; multiplier 36 outputs a signal $\alpha$ which corresponds to the acceleration of hammer HM. This signal $\alpha$ is integrated by integrator 37, and a signal $\beta$ which corresponds to the rate of change of the velocity of hammer HM is outputted from integrator 37. Then, this signal $\beta$ is inputted together with the signal $V_0$ corresponding to the initial velocity of hammer HM into integrator 38, and the integrator 38 outputs a signal y which corresponds to the displacement of the aforesaid hammer HM.

On the other hand, the signal F, which corresponds to the reverse force of hammer HM and string SP and is outputted from ROM 35, is inputted into adders 22 and 26 of loop circuit 28 as the rate of change of the velocity imposed on string SP by means of hammer HM. Conventionally, the results of the calculation of the rate of change of the velocity of string SP by the multiplication of a coefficient which corresponds to the resistance to the change in velocity of string SP by signal F, which corresponds to the reverse force, are inputted into loop circuit 28, but in the present preferred embodiment, a coefficient is included which corresponds to the aforesaid resistance in addition to the aforesaid multiplication coefficient adm.

In the following, the operation of the present preferred embodiment will be explained. In the state prior to striking, hammer HM is separated from string SP, and the relative displacement $y-x$ has a negative value. Furthermore, the sample period delay circuits in the integrators 32, 37, and 38 are reset to 0. Then, when a signal $V_0$ corresponding to the initial velocity of the hammer is outputted from a musical tone generation control circuit which is not shown in the diagram, the signal $V_0$ is integrated by means of integrator 38, and the signal y corresponding to the displacement of hammer HM is changed from a negative to a positive value with a time lapse. In this period, since hammer HM and string SP are separated, the relative displacement $y-x$ has a negative value. In addition, signal F is 0, as is shown in FIG. 9, so that the output $\beta$ of integrator 38 is 0. Accordingly, only the initial velocity $V_0$ is integrated by integrator 38, and the integral value y corresponding to the position of hammer HM goes from negative to positive, in other words, it changes in a direction which approaches string SP.

Then, when hammer HM makes contact with string SP and the relative displacement $y-x$ passes 0 and acquires a positive value, signal F corresponding to the size of the reverse force in response to relative displacement $y-x$ is outputted from ROM 35. Next, as stated above, this signal F is multiplied by the coefficient $-1/M$ and signal $\alpha$ (negative value) corresponding to the acceleration of hammer HM is created, and finally, the signal $\alpha$ is integrated, and signal $\beta$ corresponding to the component of the change in velocity over time is obtained. Here, as signal $\beta$ acquires a negative value, integrator 38 performs an integral calculation; more specifically, it subtracts signal $\beta$ from initial velocity $V_0$. Accordingly, the change over time of the increase in the displacement y of hammer HM becomes gradually slow. Furthermore, although the displacement y of hammer HM increases in a positive direction during this period, as the relative displacement $y-x$ increases, the reverse force F which hammer HM receives from string SP increases, as indicated by arrow $F_1$ in FIG. 9. Accordingly, acceleration $\alpha$ and velocity-change component $\beta$ become large in a negative direction. In addition, when the size of signal $\beta$ surpasses initial velocity $V_0$, and the direction of the velocity of hammer HM changes to a direction away from string SP, y changes to a negative direction. Then, the relative displacement $y-x$ of hammer HM and string SP slowly becomes smaller, and signal F corresponding to the reverse force received by hammer HM from string SP becomes small (arrow $F_2$). In addition, the relative displacement $y-x$ is less than 0, in other words, hammer HM moves away from string SP, it is disengaged from the elasticity characteristics of string SP, and the operation of striking the string is completed. In this way signal F corresponding to the reverse force of string SP at the time of the operation of striking the string is created, and the signal F is inputted into loop circuit 28 as a contributing component moving hammer HM toward the change in velocity of string SP. In this way, the signal contributing the change in velocity of string SP is put into loop circuit 28 as an excitation signal, and is circulated around this circuit. This signal circulating around loop circuit 28 is then used as a musical tone signal. In this example, the position at which the musical signal is retrieved may be chosen freely. The musical tone signal is slowly attenuated by filter 23.

It is possible to make many modifications to the musical tone synthesizing apparatus shown in FIG. 7. For example, FIG. 10 shows an example in which signal $V_0$ corresponding to the initial velocity of hammer HM is set to the initial value in the delay circuit of integrator 37, and signal F corresponding to the reverse force is recycled to the reverse force calculating system through the medium of delay circuit 39 and adder 40.

In the preferred embodiment described above, a case was described in which a musical tone synthesizing apparatus was realized using digital circuitry, however, it is of course possible to realize this by means of analog circuitry, and the effects obtained will be the same as those obtained in the case in which digital circuitry was used. Furthermore, it is also possible to use the wave guide disclosed in Japanese Patent Application, Laid-open publication No. 63-40199 as a loop circuit including a delay circuit.

What is claimed is:

1. A musical tone synthesizing apparatus comprising:

(a) closed-loop means functioning as a closed loop circuit and including delay means having a delay interval corresponding to a pitch of a musical tone to be synthesized, wherein a signal is circulated in the closed loop circuit to create a standing wave and the circulating signal is picked up from the closed loop circuit as a musical tone signal;

(b) control signal means for generating a first control signal and a second control signal;

(c) excitation means outside of the closed loop circuit for creating excitation signal, including means for providing a signal having a value corresponding to an output of the closed loop circuit and the first control signal and converting the provided signal in accordance with a conversion characteristic having a linear range and a non-linear range, the excitation means including means for expanding or contracting the linear range in response to the second control signal, the excitation means supplying the created excitation signal into the closed-loop means to affect signal circulating in the closed loop circuit.

2. A musical tone synthesizing apparatus in accordance with claim 1, wherein the control signal means provides a control signal corresponding to the plucking of a vibrating element and the excitation means creates an excitation signal which corresponds to the excitation imposed on the vibrating element by the plucking of the vibrating element and supplies the excitation signal into the closed-loop means.

3. A musical tone synthesizing apparatus in accordance with claim 1 which simulates tones of a musical instrument having a vibrating element having predetermined resonance characteristics, wherein the closed-loop means comprises:

(a) first delay means having a delay interval corresponding to vibration propagation from a predetermined point on the vibrating element in a first direction from the predetermined point;

(b) second delay means having a delay interval corresponding to vibration propagation in a second direction from the predetermined point opposite from the first direction;

(c) first inverting means for phase-inverting the excitation signal and outputting the phase inverted excitation signal to the first delay means;

(d) second inverting means for phase-inverting the excitation signal and outputting the phase-inverted excitation signal to the second delay means;

(e) filtering means having frequency characteristics of the vibrating element and attenuating the excitation signal in accordance with the frequency characteristics of the filtering means;

(f) first adding means for adding the excitation signal outputted by the excitation means to the signal outputted by the first delay means; and (g) second adding means for adding the excitation signal outputted by the excitation means to the signal outputted by the second delay means.

4. A musical tone synthesizing apparatus in accordance with claim 1 which simulates tones of a musical instrument having a vibrating element which is set into vibration by an operator, wherein the excitation means is provided with a memory means for storing a table of a nonlinear function representing responses of the vibrating element for various relative velocities between the operator and the vibrating element, and the excitation means outputs a predetermined excitation signal in response to a relative velocity between the operator and the vibrating element.

5. A musical tone synthesizing apparatus in accordance with claim 4, wherein the memory means comprises non-volatile memory.

6. A musical tone synthesizing apparatus in accordance with claim 1, wherein the delay means comprises shift registers comprising flip-flops corresponding to the number of bits of the excitation signal.

7. A musical tone synthesizing apparatus for synthesizing musical tones comprising:

(a) closed-loop means functioning as a closed loop circuit and including delay means having a delay interval corresponding to a pitch of the musical tone to be generated, wherein a signal is circulated in the closed-loop circuit to create a standing wave and the circulating signal is picked up from the closed-loop circuit as a tone signal;

(b) conversion means for converting a first signal representative of a first physical property into a second signal representative of a second physical property related to the first physical property; and (c) excitation means for creating an excitation signal responsive to an output of the closed-loop means and to an output of the conversion means, wherein the excitation signal from the excitation means is coupled tot he conversion means thereby to constitute a feedback loop around the excitation means separate from the closed-loop, the excitation means supplying the created excitation signal into the closed-loop means to affect signal circulation in the closed loop circuit.

8. A musical tone synthesizing apparatus in accordance with claim 7 which simulates tones of a musical instrument having a vibrating element which is struck by an operator, wherein the excitation means creates an excitation signal corresponding to the excitation imposed on the vibrating element by the striking of the vibrating element by the operator and inputs the excitation signal to the closed-loop means.

9. A musical tone synthesizing apparatus in accordance with claim 7 which simulates tones of a musical instrument having a vibrating element having predetermined resonance characteristics which is set into vibration by an operator, wherein the excitation means includes a memory means in which a table of a nonlinear function is stored, wherein the table indicates the relationship between (a) the relative displacement between the vibrating element and the operator and (b) the resiliency in operation between the vibrating element and the operator, wherein the memory means outputs a signal representative of the resiliency as the excitation signal in response to the relative displacement.

10. The musical tone synthesizing apparatus in accordance with claim 9 wherein the memory means comprises non-volatile memory.

11. A musical tone synthesizing apparatus in accordance with claim 1 wherein the excitation means includes means for causing the excitation signal to be zero when the control signal becomes zero, wherein a signal can continue to circulate in the closed-loop circuit even when the excitation signal is zero.

12. A musical tone synthesizing apparatus according to claim 1 wherein the excitation means includes:

adding means for adding an output signal of said closed-loop means tot he output signal of said control signal generating means.

13. An apparatus as in claim 12 wherein the excitation means generates an excitation signal having a pulse shape.

14. An apparatus as in claim 12 wherein the excitation means includes means for initially generating a first signal in response to the control signal and a signal circulating in the loop and multiplying the first signal by the control signal to generate the excitation signal, whereby when the control signal is zero the excitation signal will be zero.

15. A musical tone synthesizing apparatus according to claim 10 wherein the excitation means includes:

adding means for adding an output signal of said closed-loop means to the output signal of said conversion means.

16. A musical tone synthesizing apparatus comprising:

a loop circuit including delay means having a predetermined delay interval corresponding to the pitch of a tone to be synthesized, wherein a signal is circulated in the loop circuit to create a standing wave, and wherein a signal is picked up from the loop circuit as a tone signal;

excitation means for creating an excitation signal in response to an output of the closed-loop circuit and an externally provided control signal and providing the excitation signal to the loop circuit to affect signal circulation in the loop circuit; and a feedback loop separate from the loop circuit which receives the excitation signal and generates the control signal in response thereto, whereby a feedback loop is created around the excitation means.

* * * * *